US006227463B1

(12) United States Patent
Porter

(10) Patent No.: US 6,227,463 B1
(45) **Date of Patent: *May 8, 2001**

(54) WATER TREATING DEVICE FOR ATTACHMENT DIRECTLY TO A HYDRANT OUTLET

(75) Inventor: Michael Porter, Frederick, MD (US)

(73) Assignee: Washington Suburban Sanitary Commission, Laurel, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/401,489

(22) Filed: Sep. 22, 1999

Related U.S. Application Data

(60) Provisional application No. 60/101,421, filed on Sep. 22, 1998.

(51) Int. Cl.[7] ..... A62C 5/02

(52) U.S. Cl. ..... 239/310; 239/310; 239/315

(58) Field of Search ..... 239/302, 303, 239/310, 315; 169/54, 70; 210/749, 198.1, 754

(56) References Cited

U.S. PATENT DOCUMENTS

| | | | |
|---|---|---|---|
| 4,666,610 | 5/1987 | Kuhns . | |
| 4,816,177 | 3/1989 | Nelson et al. . | |
| 5,069,073 | 12/1991 | Barrett . | |
| 5,207,896 | 5/1993 | Graves . | |
| 5,264,120 | 11/1993 | Graves . | |
| 5,306,425 | 4/1994 | Graves . | |
| 5,350,512 | 9/1994 | Tang . | |
| 5,384,102 | 1/1995 | Ferguson . | |
| 5,395,625 | 3/1995 | Tang . | |
| 5,405,540 | 4/1995 | Tang . | |
| 5,427,748 | 6/1995 | Wiedrich et al. . | |
| 5,556,279 | 9/1996 | Wolf et al. . | |
| 5,567,322 | 10/1996 | Rundle et al. . | |
| 5,595,659 | 1/1997 | Huang et al. . | |
| 5,674,391 | 10/1997 | Nohren, Jr. . | |
| 5,779,913 * | 7/1998 | Denkewicz et al. | 210/754 |

* cited by examiner

*Primary Examiner*—Lisa Ann Douglas
(74) *Attorney, Agent, or Firm*—Millen, White, Zelano & Branigan, P.C.

(57) ABSTRACT

Tap water supply systems are flushed by opening fire hydrants and running potable water through the fire hydrants for a period of time. Since potable water usually contains chlorine, it is necessary to remove the chlorine before the water enters rivers, streams and bays in order to protect aquatic life. This is accomplished by passing the water through a diffuser attached to the fire hydrant, which diffuser contains a mesh bag with a sodium sulfite tablet therein.

14 Claims, 2 Drawing Sheets

8
7
9
6

6
7
8
9

WATER TREATING DEVICE FOR ATTACHMENT DIRECTLY TO A HYDRANT OUTLET

RELATED APPLICATION

This patent application claims the benefit of the filing date of to U.S. Provisional Application No. 60/101,421 filed Sep. 22, 1998.

FIELD OF THE INVENTION

The present invention is directed to water treating devices which are attached directly to a fire hydrant outlet. More particularly, the present invention is directed to a water treating device such as a water dechlorinating device for systems delivering tap water.

BACKGROUND OF THE INVENTION

From time to time, it is necessary to flush water systems which deliver potable tap water. This is especially the case with newly lined fresh water mains which have been repaired by lining interior surfaces of the mains with a resin material. Before water passing through a pipe which is used for drinking water purposes, it is necessary to thoroughly flush the mains with tap water. In order to maintain water quality, it is also necessary, from time to time, to flush local tap water delivery systems such as neighborhood and subdivision tap water systems.

Generally, discharges from potable water systems result from overflow, flushing, disinfection, hydrostatic testing, mechanical cleaning or dewatering of vessels or structures used to store or convey potable water. This frequently includes fire hydrant flushing in which high velocity streams are generated on the order of 2,000 gallons per minute for a period of 10–15 minutes. By periodically testing fire hydrants, it can be determined if sufficient water is available in the system for fire fighting purposes.

Potable tap water usually contains residual chlorine. The Federal Clean Water Act and state agency regulations regarding discharges of potable water, such as regulations promulgated by the Maryland Department of the Environment, require that total maximum daily amount of residual chlorine must be less than 0.1 mg/liter. At levels higher than 0.1 mg/liter, aquatic life is endangered and fish kills occur. Since potable tap water and water discharged from fire hydrants which originates with county and municipal water systems is necessarily initially chlorinated, heavy discharges of this water will adversely affect aquatic life unless the amount of residual chlorine is reduced to less than 0.1 mg/liter. In the past, this was either not done or, when done, was attempted by injecting sodium sulfite into the discharge stream. This is a difficult process to perform and monitor because it is necessary to dispense sodium sulfite in controlled amounts according to the volume of water being treated. If there is too much sodium sulfite, it can itself cause pollution problems by interfering with pH levels and if the amount is insufficient, there will be excessive residual chlorine. It has been found that the injection approach requires not only highly skilled personnel, but extensive training. Moreover, the end result is unpredictable.

SUMMARY OF THE INVENTION

It is a feature of the invention to provide a new and improved water treatment device.

In view of this feature and other features, the invention is directed to a device for treating water flowing through a water hydrant having an outlet. The device comprises:

a chamber having a side wall, a first end defined by an end wall and a second end adapted to be corrected to the outlet of the hydrant. An opening extends through at least one of the walls. A diffuser adapted to diffuse water flowing through the opening and is associated with the chamber and a source of treatment material is disposed within the chamber for treating water flowing from the hydrant through the chamber and out of the outlet.

In a preferred aspect of the invention, the treatment material is in the form of a solid body disposed within the chamber.

In a further aspect of the invention, the treatment material is a solid dissolvable body having capable of removing residual chlorine from tap water and disposed in a water permeable bag.

In still a further aspect of the invention, the solid dissolvable body is a tablet made of sodium hypochlorite disposed in a water permeable bag.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts through the several views, and wherein.

DETAILED DESCRIPTION

Figure 1:
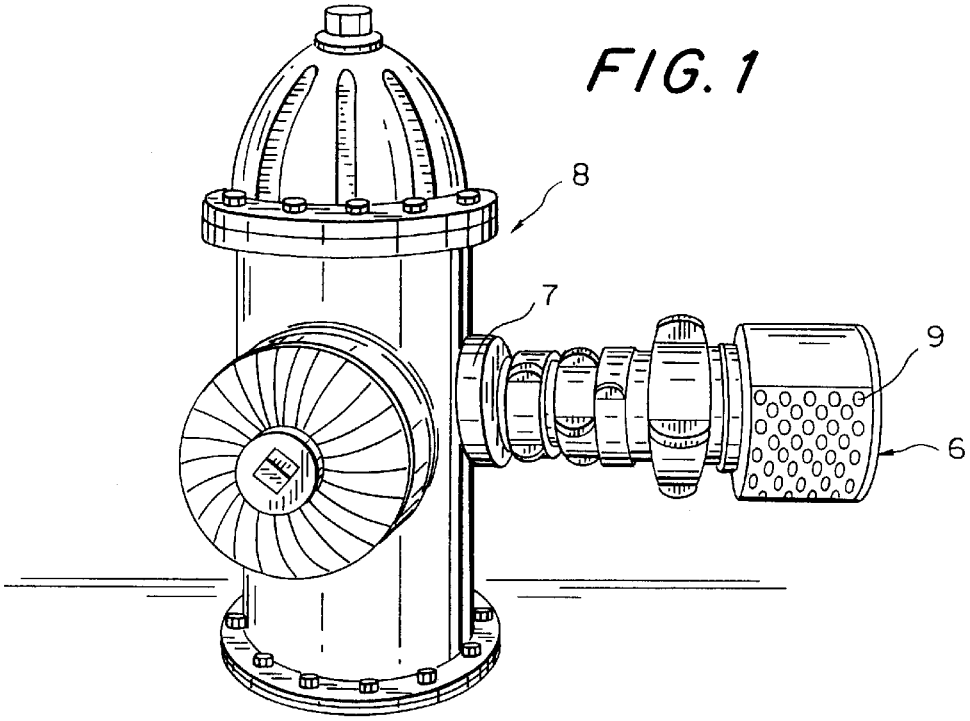
FIG. 1 is a perspective view of a water dechlorinating device according to the present invention.
Figure 2:
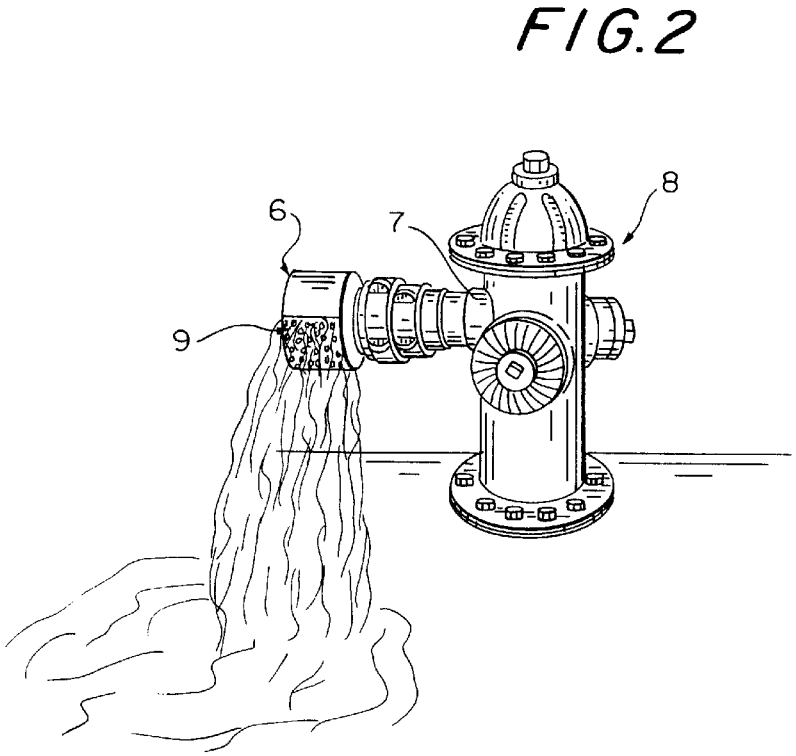
FIG. 2 is a perspective view showing the dechlorinating device of FIG. 1 in operation.

Referring now to FIGS. 1 and 2, a dechlorination device 6 according to the present invention is shown coupled directly to the outlet 7 of a fire hydrant 8.

The fire hydrant 8 is contacted by a water main to a source of tap water which in all likelihood has been treated with chlorine to kill bacteria and viruses to ensure that the tap water is potable. Potable tap water almost always contains residual chlorine which according to governmental regulations must not exceed 0.1 mg/liter at levels greater than 0.1 mg/liter tap water endangers aquatic life.

Figure 3:
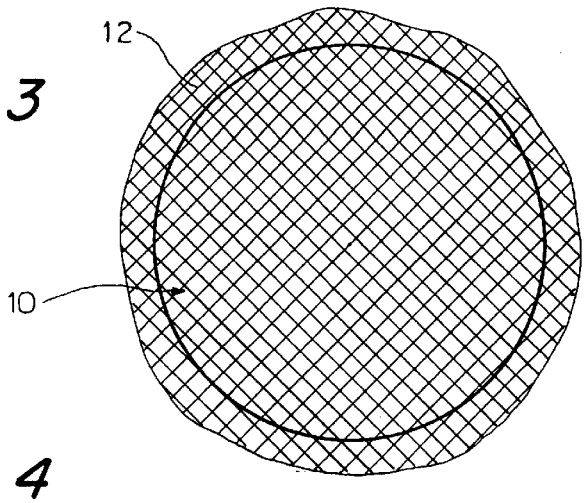
FIG. 3 is an end face view of a sodium sulfite tablet in a porous nylon mesh bag for insertion into the device of FIGS. 1 and 2.

As is seen in FIGS. 1–3, the dechlorination device 6 has a perforated side outlet 9 which diffuses the stream of tap water so as to minimize ground erosion and provide an opportunity for the tap water to interact with a sodium sulfite tablet 10 disposed within the dechlorination device 6.

Referring now more specifically to FIG. 3, the sodium sulfite ($Na_2SO_3$) tablet 10 is disposed in a permeable bag 12, such as a porous nylon mesh bag. While a single tablet 10 is preferred, a plurality of smaller tablets within the mesh bag may also be used. Sodium sulfite tablets 10 are available under the trademark D-CHLOR™ from Exceltech International Corporation of Sugar Land, Tex. When water containing residual chlorine comes in contact with the bagged tablet 10, the sodium sulfite reacts immediately with and eliminates free available chlorine.

Figure 4:
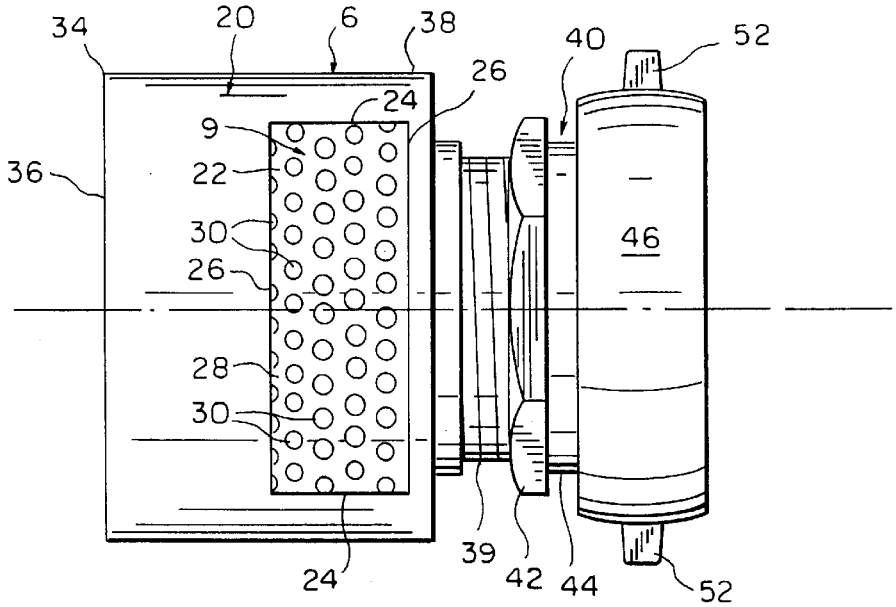
FIG. 4 is a side view of the water dechlorinating device of FIGS. 1 and 2 which receives the sodium sulfite tablet of FIG. 3 while contained within the bag.
Figure 5:
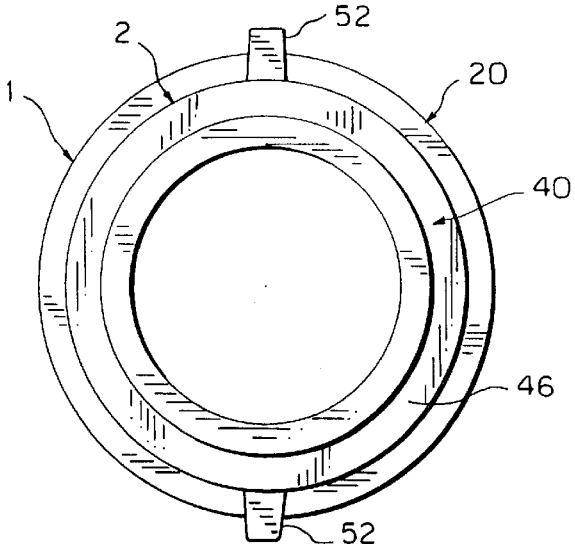
FIG. 5 is an end view of the water dechlorinating device of FIGS. 1, 2 and 4.

Referring now to FIGS. 4 and 5, the bagged sodium sulfite tablet 10 of FIG. 3 is mounted in the chamber 20 the dechlorinating device 6. The chamber 20 is cylindrical in shape and annular in cross-section. Chamber 20 includes an opening 22 through the side wall thereof. The opening 22 has parallel axially extending sides 24 and parallel arcuate sides 26. Disposed within the chamber 20 is a screen or perforated plate 28 that has a plurality of holes 30 which forms a diffuser.

Chamber 20 has a first end 34 which is closed by a circular end plate 36 to form an end wall and a second end 38 to which a threaded inlet 39 is fixed. The threaded inlet 39 projects outwardly from the chamber 20 and has a coupling 40 mounted thereon. The coupling 40 includes a nut 42 which is threaded onto the inlet 39 and a sleeve 44 onto which a lugged internally threaded nut 46 is mounted. The internally mounted nut 46 is sized to threadably receive the outlet 6 of the fire hydrant 7 in a conventional manner. In a conventional manner, there is a gasket (not shown) within the internally threaded nut 46 which abuts the end of the sleeve 44 so that when the nut 46 is rotated, the end of the fire hydrant outlet (not shown) compresses the gasket in a conventional manner so that there is a water tight seal between the fire hydrant outlet 6 and the water dechlorinating device 5. The internally threaded nut 46 has a pair of lugs 52 thereon which, in a conventional manner, permit rapid attachment of the water dechlorinating device 5 to the fire hydrant outlet 6.

In use, the bagged sodium sulfite tablet 10 is inserted into the chamber 20 through the inlet 39. The water dechlorinating device 6 is then mounted on the fire hydrant 7 with the opening 22 facing sideways so that the discharge neither impacts directly on the ground nor is expended upwardly. The perforated plate 28 acts as a diffuser while retaining the water in the chamber 20 for a sufficient time to react residual chlorine and residual calcium hypochlorite in the water with the sodium sulfite of the tablet 10 to thereby remove residual chlorine from water by turning it into calcium chloride (and sodium sulfate), substances which will not harm aquatic life. When the sodium sulfite tablet 10 is depleted, the water is shut off and a new bag 12 containing a fresh sodium sulfite tablet 10 is inserted into the chamber 20. From the foregoing description, one skilled in the art can easily ascertain the essential characteristics of this invention, and without departing from the spirit and scope thereof, can make various changes and modification of the invention to adapt it to various usages and conditions.

Without further elaboration, it is believed that one skilled in the art can, using the preceding description, utilize the present invention to its fullest extent. The preceding preferred specific embodiments are, therefore, to be construed as merely illustrative, and not imitative of the remainder of the disclosure in any way whatsoever.

What is claimed is:

1. A device for treating water flowing through a water hydrant having an outlet, the device comprising:

a chamber having a side wall, a first end defined by an end wall and a second end providing an inlet adapted to be connected to the outlet of the hydrant for receiving a stream of water from the hydrant;

an opening through the side wall through which the stream of water flows after being deflected by the end wall;

a diffuser aligned with the opening for diffusing water flowing through the opening: and a source of treatment material disposed within the chamber for treating the stream of water flowing from the hydrant through the chamber and out of the outlet.

2. The device of claim 1, wherein the diffuser is an array of perforations aligned with the opening.

3. The device of claim 1 wherein the chamber is cylindrical with the side wall extending axially and the end wall extending transversely of the side wall.

4. The device of claim 1, wherein the source of treatment material is solid and is contained within a separate container disposed within the chamber.

5. The device of claim 4, wherein the treatment material is in tablet form and wherein the separate container is a bag with a fluid pervious wall.

6. The device of claim 5, wherein the treatment material is sodium sulfite, which combines with residual chlorine and residual calcium hypochlorite to produce calcium chloride.

7. The device of claim 6, wherein the tablet is a single tablet.

8. A device for treating water flowing through a fire hydrant having a threaded outlet, the device comprising:

a chamber having a side wall, a first end defined by an end wall and a second end providing an inlet for receiving a stream of water from the hydrant and adapted to be threaded to the outlet of the hydrant;

an opening through the side wall through which the stream of water flows after being deflected by the end wall;

a diffuser aligned with the opening for diffusing water flowing through the opening; and a source of treatment material disposed within the chamber for treating the stream of water flowing from the hydrant through the chamber and out of the outlet to remove chlorine therefrom.

9. The device of claim 8, wherein the diffuser is an array of perforations aligned with the opening.

10. The device of claim 8, wherein the chamber is cylindrical.

11. The device of claim 8, wherein the source of treatment material is solid and is contained within a separate container.

12. The device of claim 11, wherein the treatment material is in tablet form and wherein the separate container is a bag with a fluid pervious wall.

13. The device of claim 12, wherein the treatment material is sodium sulfite, which reacts with residual chlorine and residual calcium hypochlorite to produce calcium chloride.

14. The device of claim 13, wherein the tablet is a single tablet.

* * * * *